US005855346A

United States Patent [19]

Hall

[11] Patent Number: 5,855,346

[45] Date of Patent: Jan. 5, 1999

[54] SELF-CLAMPING LADDER CADDY

[76] Inventor: John R. Hall, 38 Willow La., New Hartford, Conn. 06057

[21] Appl. No.: 948,567

[22] Filed: Oct. 10, 1997

[51] Int. Cl.[6] ..... F06C 7/14

[52] U.S. Cl. ..... 248/210; 248/238; 248/246

[58] Field of Search ..... 248/210, 211, 248/238, 246, 689, 322, 339, 228.3, 231.4, 222.41, 229.11

[56] References Cited

U.S. PATENT DOCUMENTS

| | | | |
|---|---|---|---|
| 639,611 | 12/1899 | Randall | 248/210 |
| 1,221,658 | 4/1917 | Berry | 248/210 |
| 2,048,430 | 7/1936 | Corrello | 248/210 |
| 2,601,413 | 6/1952 | Miles | 248/211 |
| 2,912,205 | 11/1959 | Toune | 218/210 |
| 3,052,442 | 9/1962 | Rankin, Jr. | 248/210 |
| 3,272,467 | 9/1966 | Kussube | 248/211 |
| 3,319,916 | 5/1967 | Malicoat | 248/210 |
| 3,822,847 | 7/1974 | Emmons | 248/210 |
| 3,987,993 | 10/1976 | Hopkins | 248/210 |
| 4,445,659 | 5/1984 | LaChance | 248/210 |
| 4,480,810 | 11/1984 | Hall | 248/238 |
| 4,527,763 | 7/1985 | Woytowich | 248/238 |
| 4,730,802 | 3/1988 | Chatham et al. | 248/238 |
| 4,776,550 | 10/1988 | Storey | 248/210 |
| 4,984,763 | 1/1991 | O'Donnell | 248/218.1 |
| 5,106,045 | 4/1992 | Bezotte | 248/210 |
| 5,106,046 | 4/1992 | Rowles et al. | 248/311.2 |
| 5,154,383 | 10/1992 | Collinson | 248/211 |
| 5,181,682 | 1/1993 | Indelicato | 248/210 |
| 5,443,234 | 8/1995 | Woods | 248/246 |
| 5,542,553 | 8/1996 | Penniman | 211/70.6 |

*Primary Examiner*—Leslie A. Braun
*Assistant Examiner*—Tan Le
*Attorney, Agent, or Firm*—William C. Crutcher

[57] ABSTRACT

A ladder caddy with a tray and handles for carrying tools, supplies or paint cans, which attaches to the side of a ladder by self-clamping action due to the weight of the caddy, but which releases when lifted by its carrying handles to move to another location.

7 Claims, 4 Drawing Sheets

SELF-CLAMPING LADDER CADDY

This invention relates generally to a ladder caddy for supporting tools, paint cans or supplies for persons working on a ladder, and more particularly to a ladder caddy which is self-clamping and easily detachable for moving to different locations on a ladder.

DESCRIPTION OF THE PRIOR ART

The prior art discloses many types of accessories for attachment to ladders and step ladders to hold tools, supplies, paint cans and the like. A number of devices are dependent upon cooperation with the rungs of the ladder, such as U.S. Pat. No. 4,445,659 issued May 1, 1984 to LaChance and U.S. Pat. No. 5,181,682 issued Jan. 26, 1993 to Indelicato used with hollow rung ladders. Similarly, U.S. Pat. No. 3,822,847 issued Jul. 9, 1974 to Emmons discloses a tray with a side clamp designed to rest on top of the rungs or steps of a ladder with a supporting arm beneath cooperating with the upright.

Other ladder caddies or paint can holders have been disclosed with clamps which are tightened against the ladder uprights and therefore are not dependent upon the rungs to support the accessory. Examples of such devices are shown in U.S. Pat. No. 2,912,205 issued Nov. 10, 1959 to Toune and U.S. Pat. No. 5,106,045 issued Apr. 21, 1992 to Bezotte.

In order to avoid clamps which are tightened or devices which depend upon support on the ladder rungs, a number of "self-clamping" devices have been disclosed which employ a pinching or binding effect on the upright of the ladder. U.S. Pat. No. 2,048,430 issued Jul. 21, 1936 to Corrello and U.S. Pat. No. 2,601,413 issued Jun. 24, 1952 to Miles each disclose a bracket for supporting paint cans which is supported by the binding effect from the weight of the paint can, the latter Miles patent including a lateral adjustment to accommodate different widths of the ladder upright. A separate platform for holding tools or paint cans with a bracket attachment, which is adjustable in width by a wing nut is disclosed in U.S. Pat. No. 4,527,763. Rather than utilizing the weight of the device to provide a friction binding, a spring applies a biasing downward force to secure the tray.

Lastly, caddies comprising segmented boxes for tools and the like with a carrying handle are disclosed in U.S. Pat. No. 4,730,802 issued Mar. 15, 1988 to Chatham et al. and U.S. Pat. 5,542,553 issued Aug. No. 6, 1996 to Penniman. These ladder caddies with carrying handles are designed for step ladders requiring a diverging pair of ladder uprights and are locatable at only one position on a step ladder.

It would be desirable to have a universal ladder caddy for holding tools, paint cans or supplies which may be located at any vertical position on either a leaning ladder or a step ladder, which is not dependent upon the ladder rungs for attachment. Furthermore, it would be desirable to have a ladder caddy which is self-clamping at any position on the ladder upright, but which may be easily detached and moved to another location while working on the ladder.

Accordingly, one object of the present invention is to provide an improved self-clamping ladder caddy.

Another object of the invention is to provide an improved universal ladder caddy which is useable with any type of ladder at any height on the ladder.

Another object of the invention is to provide an improved ladder caddy which is easily detachable and moveable to another work position on the ladder.

SUMMARY OF THE INVENTION

Briefly stated, the invention comprises a self-clamping caddy for attachment to a ladder upright having first and second parallel, horizontally spaced, vertically extending surfaces, the caddy comprising an open tray having a bottom and sidewalls, handle means arranged to support the tray from above so that the bottom is substantially level, first gripping means attached to the tray comprising a first friction member facing outwardly from a sidewall of the tray near the bottom thereof, second gripping means attached to the tray comprising a second friction member disposed higher than the first friction member and facing inwardly toward the sidewall with the second friction member spaced a greater distance from the sidewall than the first friction member, means for adjusting the spacing in a horizontal direction between the first and second friction members, and means for clamping the adjusting means when the first and second friction members are spaced apart in a horizontal direction slightly greater than the respective horizontally spaced vertical surfaces, such that the weight of the tray causes the first and second friction members to engage the respective first and second vertical surfaces when the tray is not supported by the handle means, but which are disengaged when the tray is supported by the handle means.

DRAWING

The invention, together with other objects and advantages thereof, will be better understood by reference to the following description, taken in connection with the accompanying drawing, in which:

FIG. 1 is a front elevation view of a ladder with the ladder caddy of the present invention disposed thereon, FIG. 2 is a left side elevation view of the ladder and caddy, FIG. 3 is an enlarged rear elevation view of the ladder caddy with a portion of the ladder shown in phantom line, FIG. 4 is an enlarged left side elevation view of the ladder caddy with a portion of the ladder shown in phantom line, FIG. 5 is a top plan partial view of the ladder caddy, the ladder shown in phantom line.

DESCRIPTION OF THE PREFERRED EMBODIMENT

Figure 1:
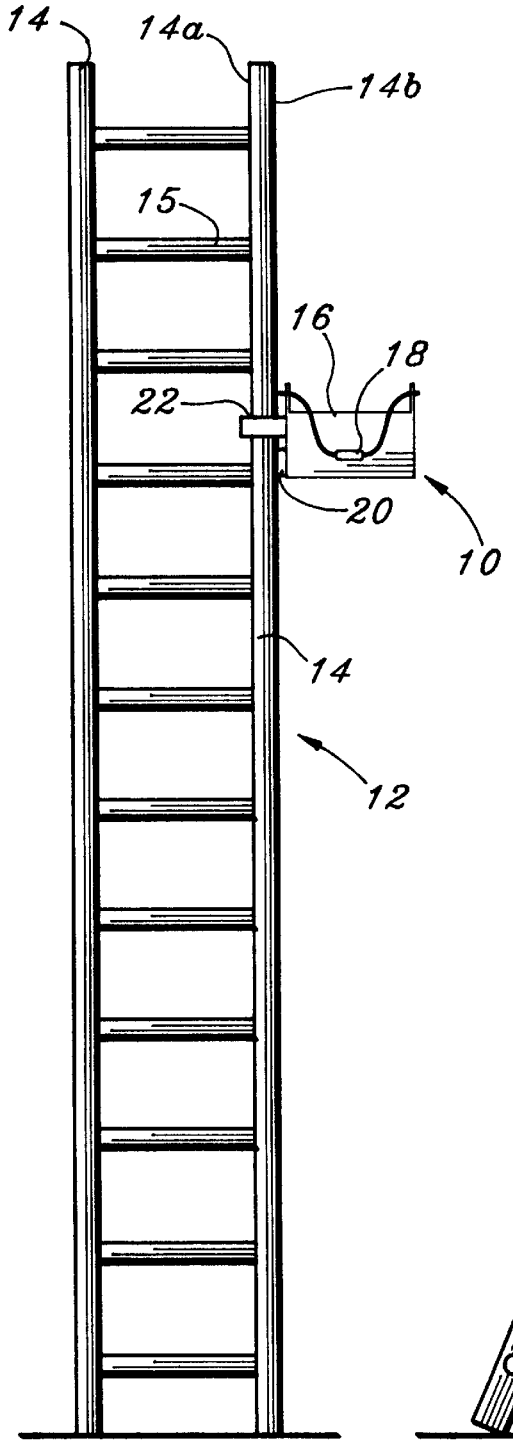
Figure 2:
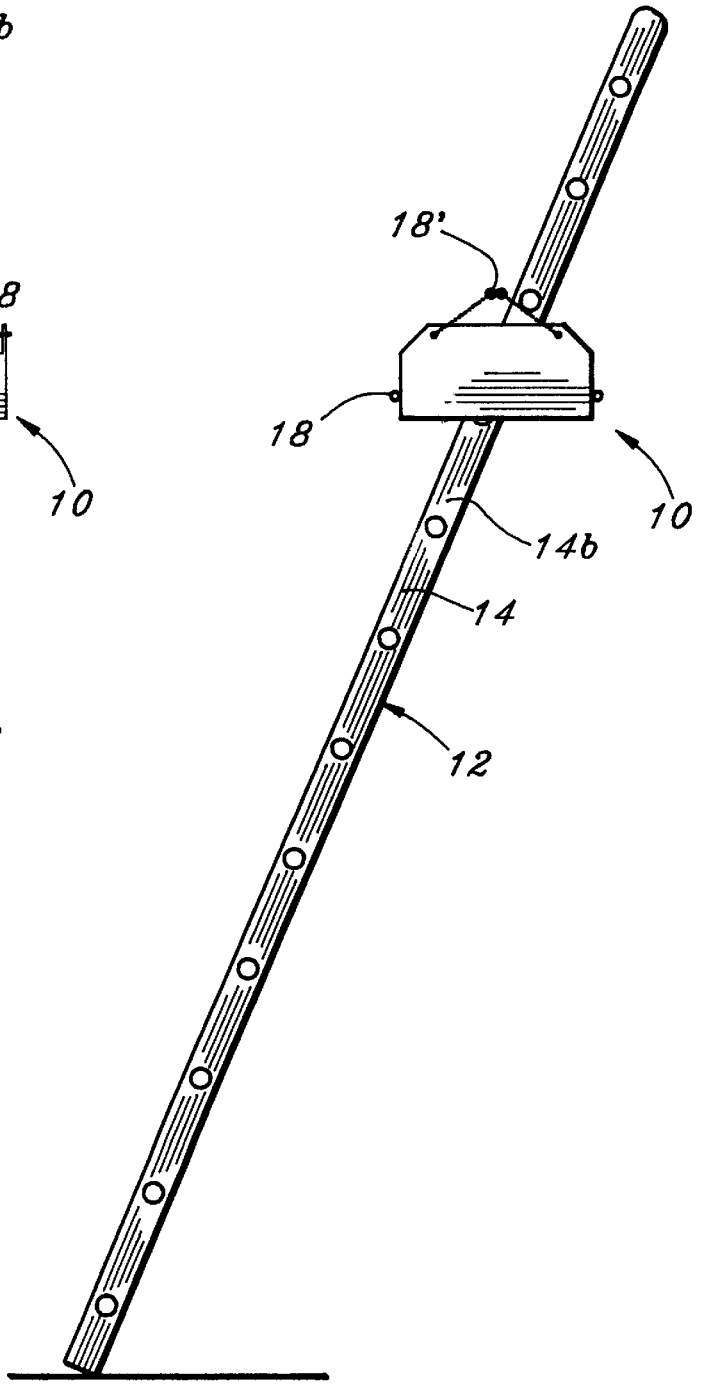

Referring to FIGS. 1 and 2 of the drawing, a ladder caddy, shown generally at 10, is supported by self-clamping action due to its own weight on a ladder shown generally at 12. Ladder 12, which may be a single ladder designed to be leaned against a side wall, or which may be one section of an extension ladder, or which may be one side of a step ladder, is comprised of two uprights 14 and rungs or steps 15. Ladder 12 may be wood or aluminum or plastic. The rungs 15 may be flat steps or hollow. Uprights 14 may be solid or of a structural shape such as a channel, and include two horizontally spaced vertically extending surfaces 14*a*, 14*b*. Surfaces 14*a*, 14*b* may be a full flat surface on the side of upright 14, or may be edges of a channel or other structural member.

Caddy 10 comprises a tray 16 with a pair of handles shown generally at 18 in a lowered position, but which may be raised and used to support tray 16 as indicated by the phantom lines 18'.

Tray 16 is supported from upright 14 on the side of the ladder by a friction binding moment applied between a first friction member 20 engaging side 14*b* of the upright and a second friction member 22 engaging side 14*a* of the upright.

The binding moment is created by the weight of the ladder caddy and its contents.

Figure 3:
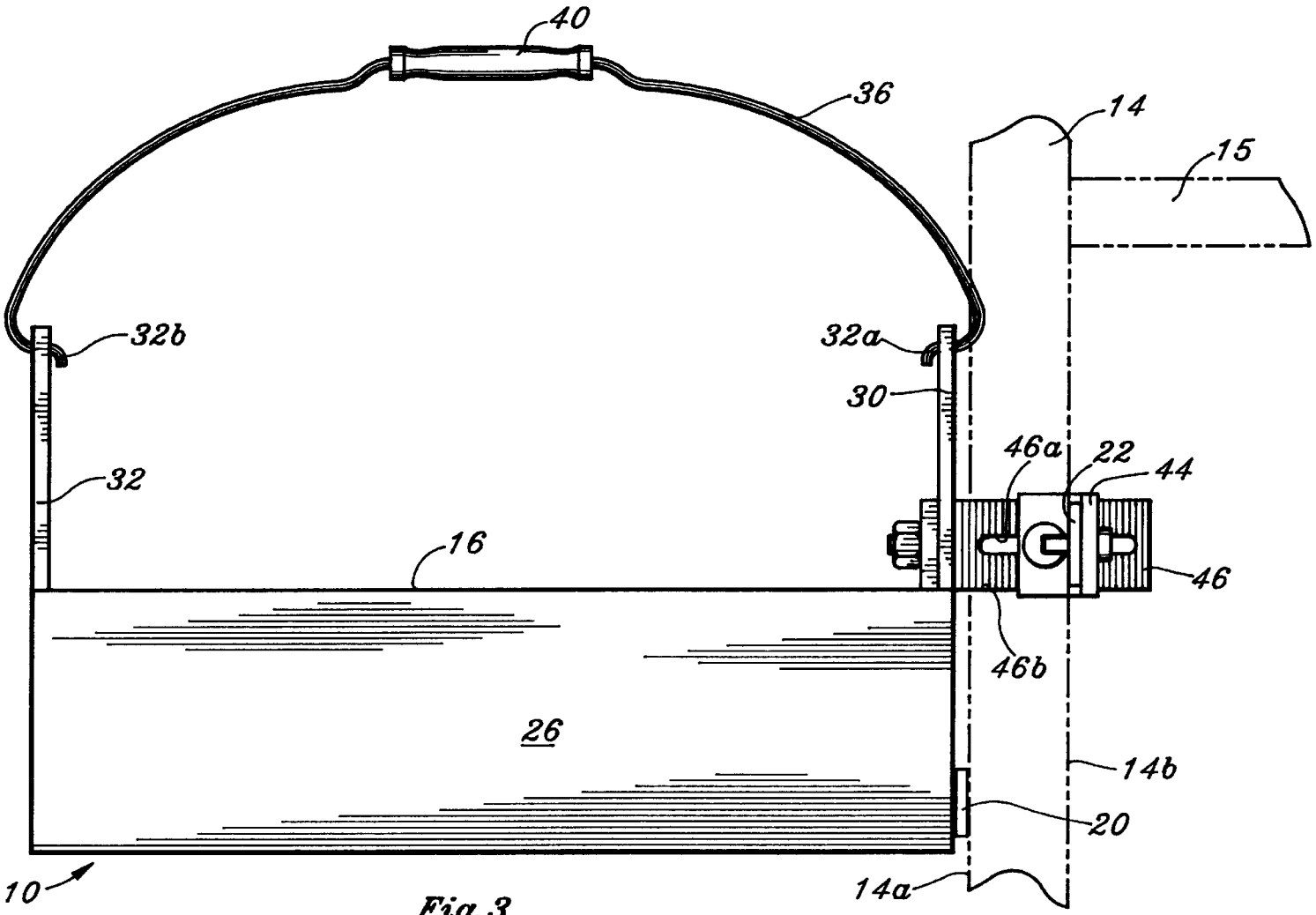
Figure 4:
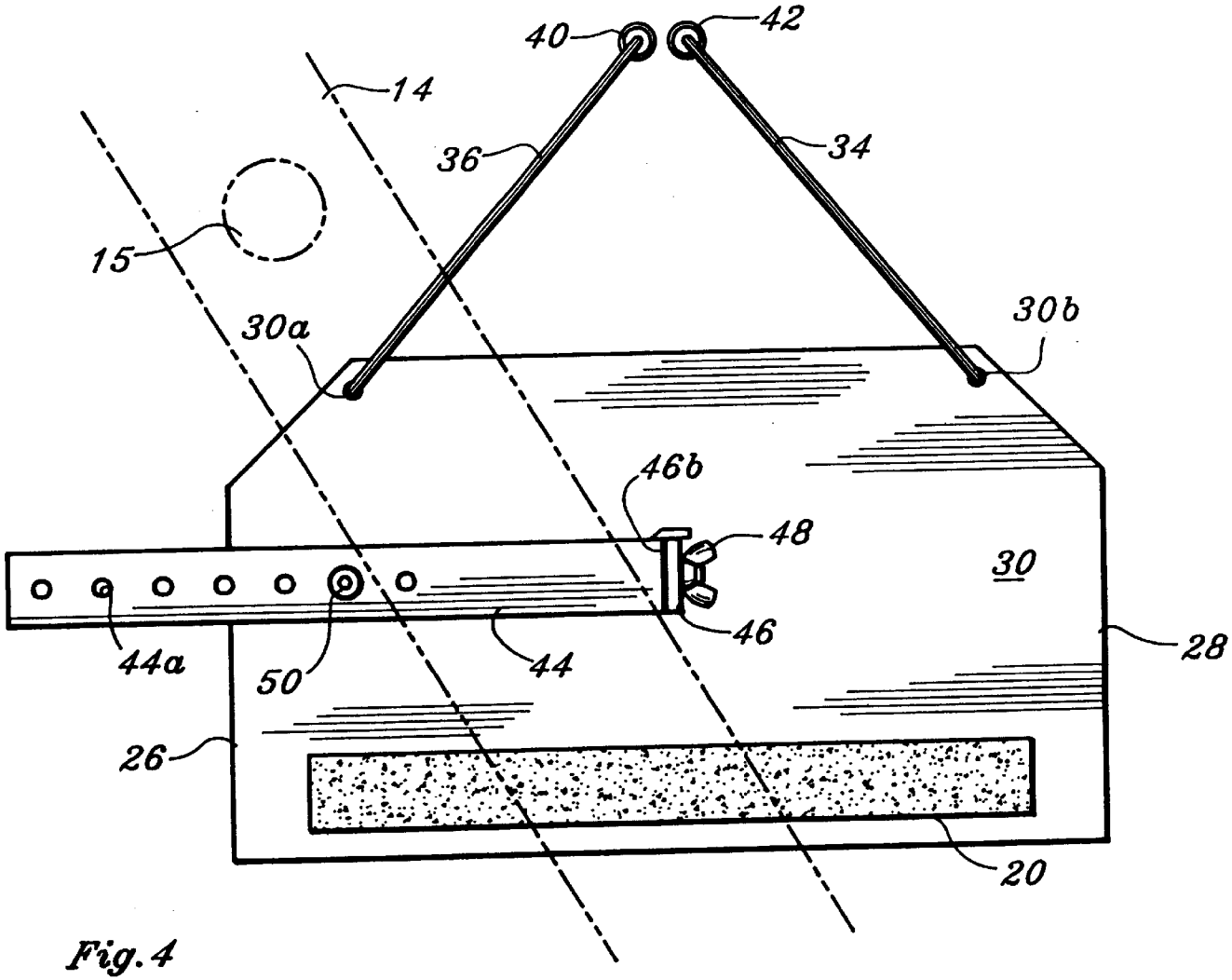
Figure 5:
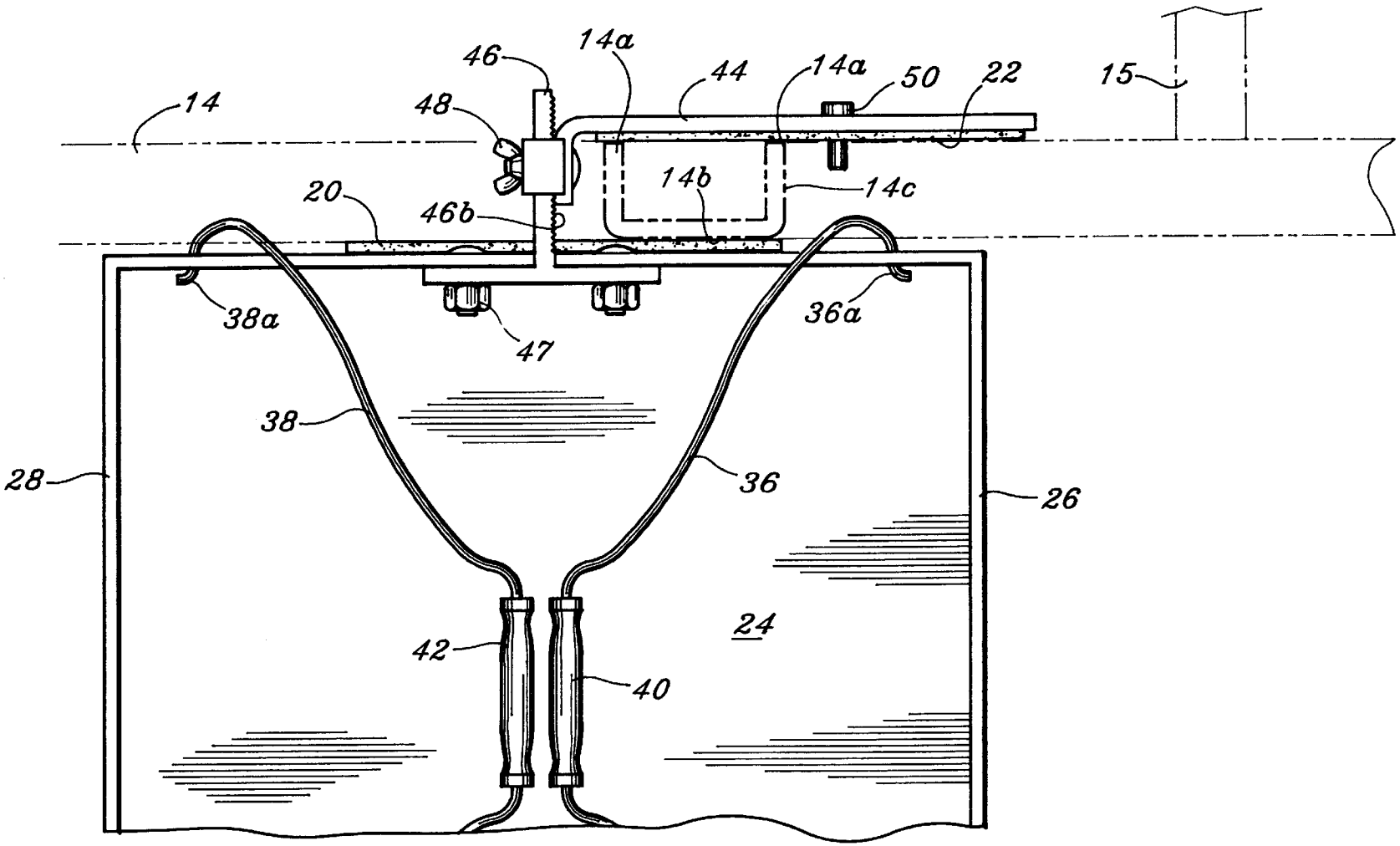

Referring now to FIGS. 3, 4 and 5 of the drawing, the details of the ladder caddy will be described. In FIGS. 3–5, the ladder upright 14 is shown in phantom line and for purposes of illustration only comprises a channel shaped aluminum upright for a ladder with hollow rungs. The invention is equally applicable to wooden uprights with flat steps, and suitable for any type of ladder.

In its preferred embodiment, ladder caddy 10 comprises an open rectangular tray 16 having a flat bottom 24, two opposed short sidewalls 26, 28 and two opposed tall sidewalls 30, 32. As best seen in FIG. 4, the tall sidewall nearest the ladder upright is provided with a pair of handle attachment holes 30*a*, 30*b*. The opposite tall sidewall 32 is similarly provided with a like pair of attachment holes. A pair of wire handles 34, 36 extend between opposed attachment holes in the two opposite sidewalls 30, 32. Each handle has a supporting wire 36 seen in FIG. 3, which is provided at its terminating end with bends 36*a*, 36*b* to hold it to the respective sidewall 30, 32 in a manner known in the art and a hand piece 40. In like manner, the handle wire 38 is similarly attached as shown at 38*a* and is provided with a hand piece 42 as shown in FIG. 5. Hand pieces 40, 42 are shown in a carrying position in FIGS. 3–5, but may be separated and folded down for access to the tools or supplies in tray 16 as shown in FIGS. 1 and 2.

Tray 16 is supported by binding action caused by rotation of the tray against a first friction member 20 and a second friction member 22 engaging the vertical surfaces 14*a*, 14*b* respectively on the ladder upright 14. Friction member 20 preferably comprises a strip of friction material such as hard rubber or roughened plastic material attached to the lower side of sidewall 30 near the bottom 24 of the tray and facing outwardly from the sidewall. The second friction member 22 is a similar strip of hard rubber or roughened plastic material facing inwardly toward sidewall 30 and disposed higher than the first friction member 20. The second friction member 22 is attached to an arm 44, which is carried on a T-shaped bracket 46. The cross member of the T is attached to sidewall 30 by bolts 47 with the center piece of the T passing through the sidewall. This provides a rugged construction for the support of the arm 44. Arm 44 is slidably adjustable along the bracket 46 by means of a slot 46*a* and a thumb screw attachment 48. A series of vertical teeth 46*b* on bracket 46 and a matching series of vertical teeth (not shown) on the angled end of arm 44 provide a positive lock and hold the arm 44 rigid with respect to the sidewall 30. By loosening the thumb screw 48, the horizontal spacing between friction members 20 and friction member 22 on the arm can be adjusted. Referring to FIG. 5, the channel shaped cross section of the ladder upright is indicated in phantom lines by reference numeral 14*c*. Arm 14 is adjusted with thumb screw 48 until the horizontal spacing between friction members 20, 20*a* is only slightly greater than the horizontal distance between surfaces 14*a* and 14*b* on the upright.

By reference to FIG. 3, it is noted that bracket 46 is also located such that friction member 22 is higher than friction member 20. The vertical distance between these two members depends upon the material selected for the friction members, the expected unloaded weight of the caddy 10, and the type of construction and material used for the caddy. The less vertical distance between friction members 20, 22, the greater the gripping or binding force applied and consequently the heavier construction required for the caddy. Therefore the vertical distance is selected according to the expected type of construction and use of the ladder caddy.

While the self-clamping action provided by the weight of the ladder caddy is sufficient to hold it in place, an added measure of safety may be provided by means such as a pin 50 pushed through one of a series of holes 44*a* in arm 44. Pin 50 is designed for simple friction fit with the friction material in friction member 22.

The arm 44 may be removed, reversed and reattached to the bracket 46, so as to extend in the opposite direction. This allows the tray 16 to be carried on the other side of the ladder. The bracket 46 may also be constructed to rotate 180° so that the arm 44 may be easily placed in position for self-clamping to either side of the ladder.

OPERATION OF THE INVENTION

The spacing is adjusted for the particular type of upright while still on the ground. Once adjusted, it is not necessary to change the adjustment. The necessary tools, supplies or paint cans are placed in the tray 16. Using the two hand pieces 40, 42 the caddy is carried by the handles, which are designed to hold the tray level, to the desired position. The tray arm 44 is inserted over the upright and the tray is released, providing a self-clamping action. Pin 50 may be added for safety. Hand pieces 40, 42 and wires 36, 38 are folded down out of the way. When it is desired to move to a different location, the tray is lifted by the handles, which automatically releases the tray for movement to a different location. The caddy is suitable for either side of the ladder, by reversing the clamping arm.

While there has been described what is considered to be the preferred embodiment of the invention, other modifications will occur to those skilled in the art, and it is desired to secure in the appended claims all such modifications as fall within the true spirit and scope of the invention.

I claim:

1. A self-clamping caddy for attachment to a ladder upright having first and second parallel, horizontally spaced, vertically extending surfaces, said caddy comprising:

an open tray having a bottom and side walls, handle means arranged to support the tray from above so that the bottom is substantially level, first gripping means attached to the tray comprising a first friction member facing outwardly from a sidewall of the tray, second gripping means attached to the tray comprising a second friction member disposed higher than the first friction strip and facing inwardly toward said sidewall with the second friction member spaced a greater distance from the sidewall than the first friction member, means for adjusting the spacing in a horizontal direction between the first and second friction members, and means for clamping the adjusting means when said first and second friction members are spaced apart in a horizontal direction slightly greater than the respective horizontally spaced vertical surfaces, such that the weight of the tray causes the first and second friction members to engage the respective first and second vertical surfaces when the tray is not supported by the handle means, but which are disengaged when the tray is supported by the handle means.

2. The combination according to claim 1, wherein said tray has first and second spaced sidewalls, and wherein the handle means include a pair of spaced handles, each of said handles extending between the first and second spaced sidewalls.

3. The combination according to claim 2, wherein each of said handles is pivotably connected to said sidewalls and adapted to fold down so as not to obstruct the contents of the tray.

4. The combination according to claim 1, wherein the first friction member comprises a strip of friction material attached near the bottom of the tray.

5. The combination according to claim 1, wherein the second gripping member comprises a bracket attached to the sidewall and having a portion extending substantially from the center thereof and an arm disposed on said bracket and extending substantially parallel to the side wall, said second friction member being attached to said arm.

6. The combination according to claim 5, wherein the arm is arranged to selectively extend in either direction from the bracket.

7. A self-clamping caddy for attachment to a ladder upright having first and second parallel, horizontally spaced, vertically extending surfaces, said caddy comprising:

an open tray having a bottom and at least first and second spaced side walls, handle means including a pair of spaced handles, each handle extending between a first and second sidewall and arranged to support the tray from above so that the bottom is substantially level, said handles being pivotably connected to the sidewalls to fold down and not obstruct the contents of the tray, first gripping means attached to the tray near the bottom thereof comprising a first friction member facing outwardly from a sidewall of the tray, second gripping means comprising a bracket attached to the tray, an arm attached to the bracket, and a second friction member attached to the arm and disposed higher than the first friction strip and facing inwardly toward said sidewall with the second friction member spaced a greater distance from the sidewall than the first friction member, means for adjusting the spacing in a horizontal direction between the first and second friction members, and means for clamping the adjusting means when said first and second friction members are spaced apart in a horizontal direction slightly greater than the respective horizontally spaced vertical surfaces, such that the weight of the tray causes the first and second friction members to engage the respective first and second vertical surfaces when the tray is not supported by the handle means, but which are disengaged when the tray is supported by the handle means.

* * * * *